United States Patent [19]

Jeffries et al.

[11] Patent Number: 4,577,135

[45] Date of Patent: Mar. 18, 1986

[54] LIQUID METAL ION SOURCES

[75] Inventors: Derek K. Jeffries, Didcot; Duncan J. McMillan, Abingdon, both of England

[73] Assignee: United Kingdom Atomic Energy Authority, London, England

[21] Appl. No.: 464,677

[22] Filed: Feb. 7, 1983

[30] Foreign Application Priority Data

Feb. 22, 1982 [GB] United Kingdom ..... 8205212

[51] Int. Cl.[4] ..... H01J 1/02

[52] U.S. Cl. ..... 313/362.1; 313/363.1; 222/420; 222/510

[58] Field of Search ..... 222/420, 504–505, 222/507–510; 239/38, 37; 250/423 F; 313/230, 232, 309, 336, 339, 351, 359.1, 362.1, 363.1

[56] References Cited

U.S. PATENT DOCUMENTS

| | | | |
|---|---|---|---|
| 1,979,076 | 10/1934 | Neisworth | 222/509 X |
| 2,623,766 | 12/1952 | Richard | 222/504 |
| 2,652,175 | 9/1953 | Davis | 222/504 X |
| 2,720,343 | 10/1955 | Ross et al. | 222/420 X |
| 2,912,143 | 11/1959 | Woolfolk | 222/504 X |
| 3,331,539 | 7/1967 | Cofer et al. | 222/510 X |
| 3,475,636 | 10/1969 | Eckhardt | 313/29 |
| 3,988,627 | 10/1976 | Dustmann et al. | 313/309 |
| 4,088,919 | 5/1978 | Clampitt et al. | 313/309 |
| 4,133,918 | 1/1979 | Simms et al. | 222/420 X |
| 4,367,429 | 1/1983 | Wang et al. | 313/362.1 |
| 4,431,137 | 2/1984 | Prewett et al. | 239/690 |

FOREIGN PATENT DOCUMENTS

| | | | |
|---|---|---|---|
| 253341 | 7/1964 | Australia | 222/509 |
| 0037455 | 10/1981 | European Pat. Off. . | |
| 1442998 | 7/1976 | United Kingdom . | |

*Primary Examiner*—Joseph J. Rolla
*Assistant Examiner*—Kevin P. Shaver
*Attorney, Agent, or Firm*—William R. Hinds

[57] ABSTRACT

A source for the provision of ions or charged droplets of a liquid metal, consisting of a needle having an emitting tip, a reservoir for a liquid metal, ions or charged droplets of which are to be emitted by the source, and a sheath surrounding the needle and from which the needle projects. The sheath serves to convey liquid metal to the emitting tip of the needle at a controlled rate. There is provided a device for withdrawing the emitting tip of the needle into the sheath so as to enable the emitting tip of the needle to be immersed in the liquid metal.

15 Claims, 2 Drawing Figures

LIQUID METAL ION SOURCES

The present invention relates to sources for providing ions of liquid metals and/or charged liquid metal droplets.

A type of liquid metal ion source or droplet sprayer consists of a pointed needle from the tip of which the liquid metal ions or droplets are emitted under the action of an electric field by the well-known process of field ion emission. The liquid metal is fed to the emitting tip of the needle at a controlled rate by means of capillary and surface tension effects.

An ion source of this type is, for example, described in the assignee's U.S. Pat. No. 4,088,919, of which one of the present inventors is also a coinventor.

A problem with such sources, particularly when very reactive metals are involved, such as caesium, is that the liquid metal film ruptures causing the source to cease to operate. As liquid metal ion/droplet sources are used in vacuum conditions, such failure can cause considerable expenditure of time and effort.

According to the present invention there is provided a source for the provision of ions or charged droplets of a metal, consisting of a needle having an emitting tip, a reservoir for a metal, ions or charged droplets of which are to be emitted by the source, and a sheath surrounding the needle and from which the needle projects, the sheath serving to convey liquid metal to the emitting tip of the needle at a controlled rate, wherein there is provided means for withdrawing the emitting tip of the needle into the sheath so as to enable the emitting tip of the needle to be immersed in the liquid metal.

The means for withdrawing the emitting tip of the needle into the sheath may be electromagnetically operated or it can comprise a mechanically operated device.

The invention will now be described, by way of example, with reference to the accompanying drawings, in which:-

Figure 1:
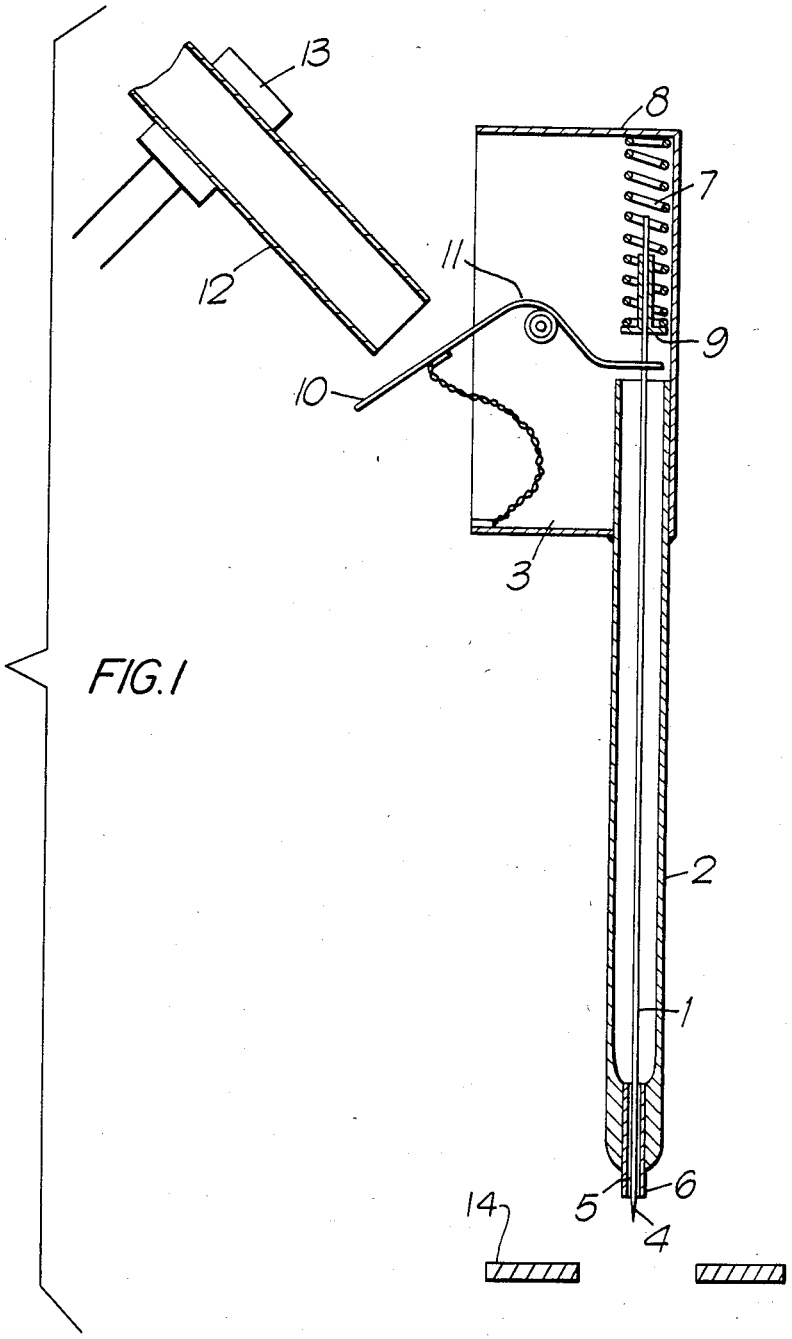
Figure 2:
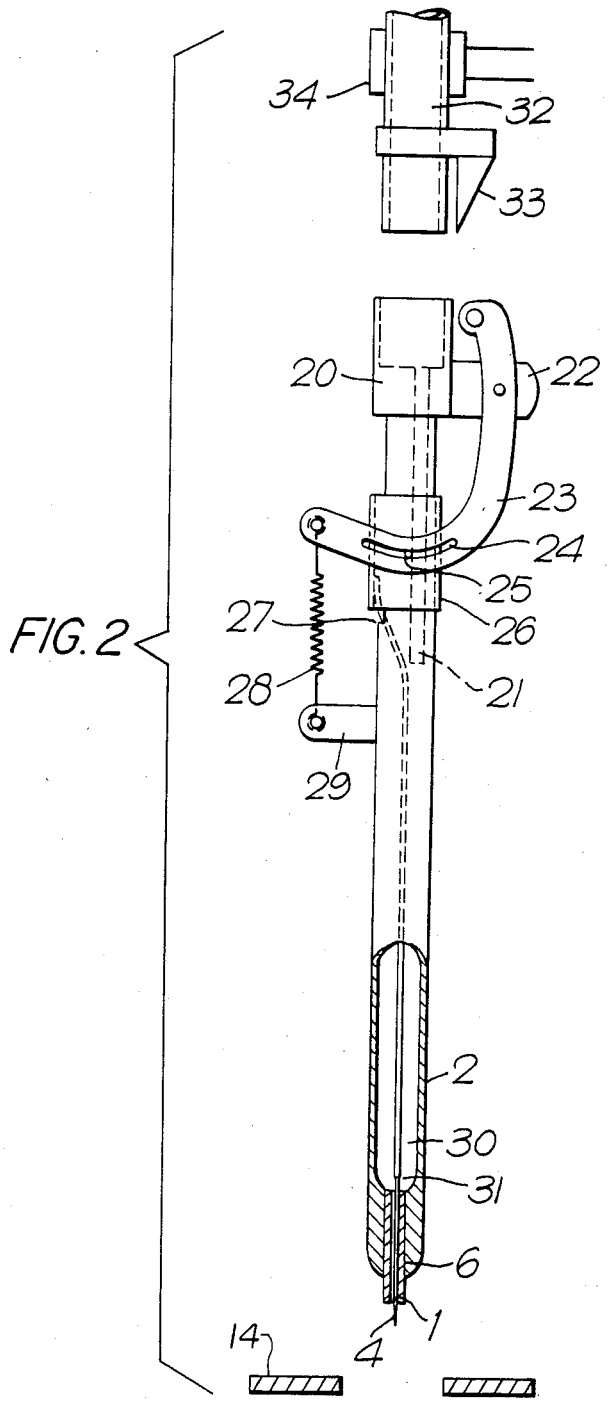

FIG. 1 is a longitudinal section of a liquid metal ion source embodying the invention; and FIG. 2 is a longitudinal section of another liquid metal ion source embodying the invention.

Referring to FIG. 1, a needle type liquid metal ion source consists of a pointed needle 1 which extends through a tubular reservoir 2 into a closed metal trough 3 which surrounds the end of the reservoir 2 which is remote from an emitting tip 4 of the pointed needle 1. The other end of the reservoir 2 terminates in a length of narrow-bore tubing 5 which forms a sheath 6 surrounding the needle 1 and out of which it normally projects. The clearance between the sheath 6 and the needle 1 is such that, coupled with the distance between the end of the sheath 6 and the tip 4 of the needle 1 from which the emission of material takes place when the needle 1 is in an operative position, either single ions or charged droplets of liquid are emitted, as required. An electric field is applied to the emitting tip 4 by an extraction electrode 14. A compression spring 7 surrounds the end of the needle 1 which projects into the trough 3 and bears against the far end 8 of the trough 3, and a collar or reaction member 9 which is fixed to the needle 1, so as to urge the needle 1 in a direction which causes it to project from the sheath 6. A rocking lever 10 is arranged to pivot about a bearing pin 11 which passes across the trough 3. One end of the lever 10 is forked and also bears on the collar 9. The other end of the lever 10 is arranged to be struck by a movable tubular feed duct 12 through which a liquid or particulate metal can be introduced into the trough 3. A braided wire enables the lever 10 and the trough 3 to be heated to maintain the metal in a liquid state, or to melt it if it is provided in a powder form. The feed duct 12 can be arranged to be moved by any convenient means, for example, a solenoid 13 or a mechanical linkage.

In use, the tubular duct 12 is moved into a position which causes the emitting tip 4 of the needle 1 to be withdrawn into the sheath 6, the liquid, or powdered, metal is introduced into the trough 3 whence it passes in the liquid state into the reservoir 2 and thence to the sheath 6. The emitting tip 4 of the needle 1 is arranged to be in a position where it is immersed in the liquid metal in the sheath 6 so that it is fully wetted by the liquid metal. The feed duct 12 is then withdrawn to a position where the lever 10 is disengaged from it so that the spring 7 can urge the needle 1 forward to its operating position. Should the liquid metal film on the needle 1 break down in use, then the feed duct 12 can be moved to withdraw the needle 1 into the duct 6 so that the liquid metal film can be re-established.

The arrangement described with reference to FIG. 1 is suitable for operation in a horizontal position. FIG. 2 shows an arrangement which can be operated in a vertical position. Those parts which are similar to corresponding parts of the first arrangement have the same reference numerals.

Referring to FIG. 2, as before, a pointed needle 1, passes through a sheath 6 and into a tubular reservoir 2. In this case, however, the reservoir 2 terminates in a hopper 20 which has a feed tube 21 extending into the reservoir 2 to one side of the needle 1. The hopper 20 has a lug 22 projecting to one side of it. Pivoted on the lug 22 are two identical C-shaped levers 23. The levers 23 each have an arcuate slot 24 in them in which bear two pins 25 which are attached to a collar or reaction member 26 which is free to slide up and down on the outside of the reservoir 2. The end of the needle 1 which is remote from the emitting tip 4 of the needle 1 is cranked and emerges through a slot 27 in the wall of the reservoir 2. The projecting end of the needle 1 is welded to the collar 26 so that movement of the collar 26 up and down the reservoir 2 causes a similar movement of the needle 1. A tension spring 28 is connected between the free ends of the levers 23 and a projection 29 on the wall of the reservoir 2. The spring 28 acts to urge the collar 26 towards the end of the reservoir 2 through which the emitting tip 4 of the needle 1 projects. In this embodiment of the invention, the major part 30 of the needle 1 is of greater diameter than the narrow bore 5 of sheath 6. A shoulder 31 is formed at the junction between the wider and narrower parts of the needle 1. The position of the shoulder 31 is such that when the collar 26 is in its rest position, the sheath 6 is closed off so that, initially, no liquid metal can pass to the emitting tip 4 of the needle 1. A movable metal feed tube 32 carries at its free end a striker 33, which is arranged to engage with the levers 23 when the feed tube 32 is inserted into the hopper 20. As before, the feed tube 32 can be moved either by means of a solenoid 34, or a mechanical linkage. Leads are provided to enable the hopper 20 and reservoir 2 to be heated so that the metal, ions of which are to be provided by the source, can be maintained in a liquid state or melted if it is provided in a powder form.

In use, when the feed tube 32 is first inserted into the hopper 20, the collar 26 and needle 1 remain in their lowest positions, so closing off the reservoir 2. As the feed tube 32 is inserted further into the hopper 20, the collar 26 is caused to move up the reservoir so retracting the needle 1 to a working position and opening the entrance to the sheath 6 so that liquid metal can pass freely to the emitting tip 4 of the needle 1, which projects from the sheath by the required amount. Further movement of the feed tube 32 into the hopper 20 causes the striker 33 to move the levers 23 and the collar 26 further up the reservoir 2 so that the emitting tip 4 of the needle 1 is withdrawn into the sheath 6. Thus to initiate the action of the ion source, the tube 32 is inserted a short way into the hopper 20, liquid metal, or powder is fed into the hopper 20 where it is melted, then the tube 20 is inserted further into the hopper 20 so that the needle 1 is withdrawn into the sheath 6 where its emitting tip is wetted, and the tube 32 is then withdrawn to a position where the emitting tip 4 of the needle 1 is in its working position in relation to the sheath 6. Once liquid metal flow to the emitting tip 4 of the neddle 1 has been established, the feed tube 32 is withdrawn to a position where the striker 33 no longer is in contact with the levers 23 so that the ion source is electrically isolated and the necessary operating high voltage can be applied to it safely. Although the needle 1 moves forward towards the closed off position, the film strength of the liquid metal is sufficient to ensure that liquid metal continues to pass to the emitting tip 4 of the needle 1. If the metal film should break down in use, then the tube 32 can be moved back so as to retract the needle 1 fully again so that its emitting tip 4 can be re-wetted.

In practice, both embodiments of the invention are used with one or more extractor electrodes as shown schematically at 14 in FIGS. 1 and 2.

Although both the embodiments of the invention have been described as ion sources, whether they provide ions as a spray of charged droplets depends on the dimensions of the emitting tip 4 of the needle 1, the distance by which it projects from the sheath 6, and the clearance between the sheath 6 and the needle 1. The extraction potential also is a controlling factor. For example, if the sources are intended to emit ions only of lithium, suitable dimensions are 100 μm for the diameter of the needle 1, a tip radius of about 5 μm, a clearance of about 25 μm between the sheath 6 and the needle 1, and a distance of about 0.1 cm between the end of the sheath 6 and the emitting tip 4 of the needle 1.

On the other hand, charged droplets are provided when the needle 1 projects about 2 mm from the sheath 5 and has a tip radius of about 60 μm.

We claim:

1. In an apparatus comprising a field ion emission source for the provision of ions or charged droplets of a liquid metal under the action of an applied electric field, and extraction electrode means for effecting the applied electric field, the improvement wherein said source comprises a needle having an emitting tip, a reservoir for a liquid metal, ions or charged droplets of which are to be emitted by the source, and a sheath surrounding the needle and from which the needle projects, the sheath serving to convey liquid metal to the emitting tip of the needle at a controlled rate, wherein there is provided means for withdrawing the emitting tip of the needle into the sheath so as to enable the emitting tip of the needle to be immersed in the liquid metal, thereby in use to initiate or reestablish flow of the metal over the projecting surface of the needle.

2. Apparatus according to claim 1, wherein the means for withdrawing the emitting tip into the sheath is operated electromagnetically.

3. Apparatus according to claim 1, wherein the means for withdrawing the needle into the sheath is operated mechanically.

4. Apparatus according to claim 1, wherein there is included a reaction member associated with the needle, means arranged to co-operate with the reaction member so as to urge the needle into an operating position where the emitting tip of the needle projects from the sheath, and means also co-operating with the reaction member to move the needle to a second position where the emitting tip of the needle is withdrawn into the sheath.

5. Apparatus according to claim 4, wherein the means for urging the needle into the operating position comprises a spring, and the means for moving the needle to the second position comprises a lever.

6. Apparatus according to claim 5 wherein the lever is arranged to be operated by a striker.

7. Apparatus according to claim 6, wherein the striker is adapted to act as a means for supplying to the reservoir the liquid metal, ions or charged droplets of which are to be emitted by the source.

8. Apparatus according to claim 5, wherein the lever is operated electromechanically.

9. Apparatus according to claim 8, wherein the lever is arranged to be operated by a striker.

10. Apparatus according to claim 9, wherein the striker is adapted to act as a means for supplying to the reservoir the liquid metal, ions or charged droplets of which are to be emitted by the source.

11. Apparatus according to claim 4, wherein the reaction member comprises a collar to which the needle is attached, the collar surrounding the reservoir and being free to move longitudinally along it and having two pins mounted thereon diametrically opposite each other, and there is provided also a bifurcated curved lever pivoted on the reservoir thereof and having two opposing arcuate slots therein in which the pins are engaged, the means for urging the needle into the operating position comprising a spring arranged to act upon one end of the lever so as to move it, and thence the collar to a position such that the needle is in its operating position, and the means for moving the needle to the second position comprises a striker arranged to bear on the other end of the lever so as to cause it to move the collar to a position at which the needle is withdrawn into the sheath.

12. Apparatus according to claim 11, wherein the striker comprises a wedge adapted to move axially with respect to the sheath.

13. Apparatus according to claim 12, wherein the striker is attached to a tubular member through which liquid metal, ions or charged droplets of which are to be emitted by the source, can be supplied to the reservoir.

14. Apparatus according to claim 12, wherein the striker is arranged to be moved electromagnetically.

15. Apparatus according to claim 14, wherein the striker is attached to a tubular member through which liquid metal, ions or charged droplets of which are to be emitted by the source, can be supplied to the reservoir.

* * * * *